US006244546B1

(12) United States Patent
Plamondon

(10) Patent No.: US 6,244,546 B1
(45) Date of Patent: Jun. 12, 2001

(54) CANTILEVERED SLIDING ELBOW REST

(76) Inventor: Orance Plamondon, P.O. Box 1348, Ashcroft, British Columbia (CA), V0K 1A0

( * ) Notice: Subject to any disclaimer, the term of this patent is extended or adjusted under 35 U.S.C. 154(b) by 0 days.

(21) Appl. No.: 09/410,091

(22) Filed: Oct. 1, 1999

Related U.S. Application Data

(60) Provisional application No. 60/106,624, filed on Nov. 2, 1998.

(51) Int. Cl.[7] ..... B68G 5/00

(52) U.S. Cl. ..... 248/118; 312/208.3; 400/715

(58) Field of Search ..... 248/118, 118.1, 248/118.5, 918; 400/715; 312/208.3

(56) References Cited

U.S. PATENT DOCUMENTS

| | | | | |
|---|---|---|---|---|
| 3,929,309 | * | 12/1975 | De Vore | 248/118 |
| 4,272,273 | | 6/1981 | Trahan et al. | 65/167 |
| 4,482,063 | | 11/1984 | Berke et al. | 211/69.1 |
| 4,621,781 | | 11/1986 | Springer | 248/118 |
| 4,709,972 | | 12/1987 | LaBudde et al. | 312/208 |
| 5,037,054 | * | 8/1991 | McConnell | 248/918 X |
| 5,056,743 | | 10/1991 | Zwar et al. | 248/118 |
| 5,058,840 | * | 10/1991 | Moss et al. | 248/118.5 |
| 5,072,905 | | 12/1991 | Hyatt | 248/118 |
| 5,139,559 | | 8/1992 | Kozora | 65/158 |
| 5,211,367 | * | 5/1993 | Musculus | 248/918 X |
| 5,334,233 | | 8/1994 | Kozora | 65/171 |
| 5,358,543 | | 10/1994 | Kozora | 65/319 |
| 5,465,931 | | 11/1995 | MacDonald | 248/118.3 |
| 5,571,274 | * | 11/1996 | Holstensson | 248/118.3 X |
| 5,595,428 | | 1/1997 | Huang | 312/223.3 |
| 5,628,483 | | 5/1997 | Smith et al. | 248/118 |
| 6,070,838 | * | 6/2000 | Luginsland | 248/118.5 |

* cited by examiner

*Primary Examiner*—Ramon O. Ramirez
(74) *Attorney, Agent, or Firm*—Antony C. Edwards

(57) ABSTRACT

A cantilevered sliding elbow rest has a cantilevered member slidably mountable into a mounting bracket. The mounting bracket has an opposed facing pair of laterally spaced apart longitudinally extending rails rigidly mounted in parallel spaced apart relation so as to accept the cantilevered member in sliding engagement therebetween. The opposed facing rails have lower opposed longitudinally extending sliding support surfaces on which the cantilevered member may be slidably supported when mounted in sliding engagement on the pair of rails. The cantilevered member is generally planar and rigid so that when the mounting bracket is mounted to an underside surface of a table top, and the cantilevered member is slidably mounted in the mounting bracket, the cantilevered member may be slid from a stowed position stored snugly between the opposed pair of rails and snugly sandwiched between the supporting surfaces and the lower surface of the table, to an extended position wherein a first portion of the cantilevered member is cantilevered outwardly of the mounting bracket. A downward bending moment applied to the first portion of the cantilevered member is resisted by a second portion of the cantilevered member remaining in snug sliding engagement in the mounting bracket beneath the table top.

4 Claims, 5 Drawing Sheets

CANTILEVERED SLIDING ELBOW REST

CROSS REFERENCE TO RELATED APPLICATION

This application claims priority from U.S. Provisional Patent Application No.60/106,624 filed Nov. 2, 1998 titled Cantilevered Sliding Elbow Rest.

FIELD OF THE INVENTION

This invention relates to the field of devices for relieving stress on the arm of an operator operating a typical mouse electrically connected to a computer.

BACKGROUND OF THE INVENTION

The fatigue typically imposed on clerical staff, draftspersons and the like who sit in front of a computer for extended periods of time is well documented. In particular, it is well documented that the arms and wrists become fatigued when holding the hands in the preferred typing position.

In the prior art, applicant is aware of various attempts to provide support so as to alleviate such fatigue. These attempts may take the form of typically rests on which may be laid the wrists of the operator while typing. Also for example, applicant is aware of U.S. Pat. No. 5,072,905 which issued Dec. 17, 1991 for Wrist and Forearm Rests which may be pivoted from underneath a table surface into a position on which may be rested the elbow and forearm of the operator. The wrists of the operator are rested on a separate pad adjacent the edge of the keyboard.

Another device of which the applicant is aware is represented in U.S. Pat. No. 5,465,931 which issued Nov. 14, 1995 again for a rest on which may be placed the operators' hands to alleviate stress of the operator using a computer keyboard. In this instance, a hand support bar is provided which rotates up into position when needed, and is pivoted out of the way onto swing arms when the rest is not required for resting of the palm of the operator.

What is neither nor suggested in the prior art of which applicant is aware is a sliding cantilevered platform which may be readily mounted underneath an operator's computer keyboard table, offset to one side so that when it is desired to use a computer mouse for an extended period of time, the cantilevered arm may be slid out from underneath the desk top for resting of the elbow and forearm thereon.

SUMMARY OF THE INVENTION

In summary, the cantilevered sliding elbow rest of the present invention includes a cantilevered member slidably mountable into a mounting bracket, wherein the mounting bracket comprises an opposed facing pair of laterally spaced apart longitudinally extending rails rigidly mounted in parallel spaced apart relation so as to accept in sliding engagement therebetween the cantilevered member. The opposed facing rails have lower opposed longitudinally extending sliding support surfaces on which the cantilevered member may be slidably supported when mounted in sliding engagement on the pair of rails.

The cantilevered member is generally planar and rigid so that when the mounting bracket is mounted to an underside surface of a table top, and the cantilevered member is slidably mounted in the mounting bracket, the cantilevered member may be slid from a stowed position stored snugly between the opposed pair of rails and snugly sandwiched between the supporting surfaces and the lower surface of the table, to an extended position wherein a first portion of the cantilevered member is cantilevered outwardly of the mounting bracket. Thus, a downward bending moment applied to the first portion of the cantilevered member is resisted by a second portion of the cantilevered member remaining in snug sliding engagement in the mounting bracket beneath the table top.

Advantageously, the pair of rails are held in parallel spaced apart relation by a rigid pair of cross members. Further advantageously, the laterally outer edges of the cantilevered member have lower longitudinally extending grooves so as to form outwardly extending longitudinal flanges along the laterally outer edges for sliding mating engagement on the supporting surfaces on the pair of rails.

In one aspect of the present invention, the upper surface of the cantilevered member is generally flush with the upper surface of the rails when the cantilevered member is mounted between the rails so that the cantilevered member may snugly slide between the rails and snugly slide beneath the lower surface of the table top.

In another aspect of the present invention, a stop may be mounted to a lower surface of the cantilevered member so as to limit the range of sliding motion of the cantilevered member relative to the mounting bracket. In one embodiment the stop may be mounted at one end, for example, the outer end of the cantilevered member. The stop abuts a cross member, for example, one of the pair of cross members, mounted between the rails when the cantilevered member is in its stowed position. A second stop may be mounted at an opposite end, for example, the inner end of the cantilevered member so as to abut the same cross member when the cantilevered member is fully extended, thus limiting the range of sliding motion of the cantilevered member.

DETAILED DESCRIPTION OF PREFERRED EMBODIMENTS

Figure 1:
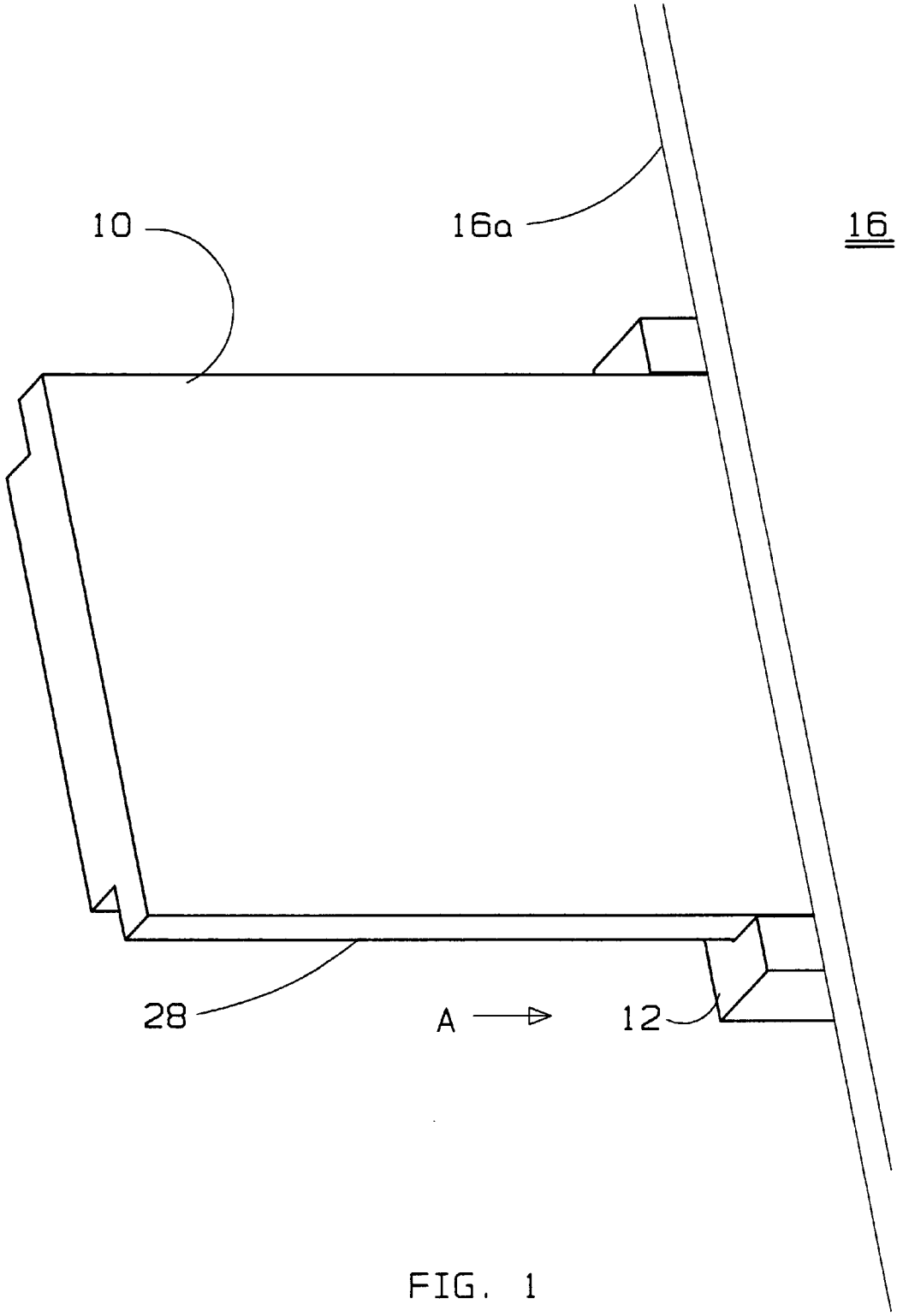
FIG. 1 is, in top perspective view, the cantilevered sliding elbow rest of the present invention extended partially cantilevered outwardly of its mounting bracket.

As seen in FIGS. 1–5, the cantilevered sliding elbow rest of the present invention has two primary components, namely, a cantilevered member 10 slidably mounted in mounting bracket 12. Mounting bracket 12 slidably supports cantilevered member 10 when mounting bracket 12 is mounted, for example by means of screws (not shown) through screw holes 14 to the underside of table top 16. The mounting bracket is mounted adjacent to one side of keyboard 17. If keyboard 17 is mounted on a keyboard tray 17*a* beneath tabletop 16, then the keyboard and cantilevered member 10 are generally co-planar.

Figure 2:
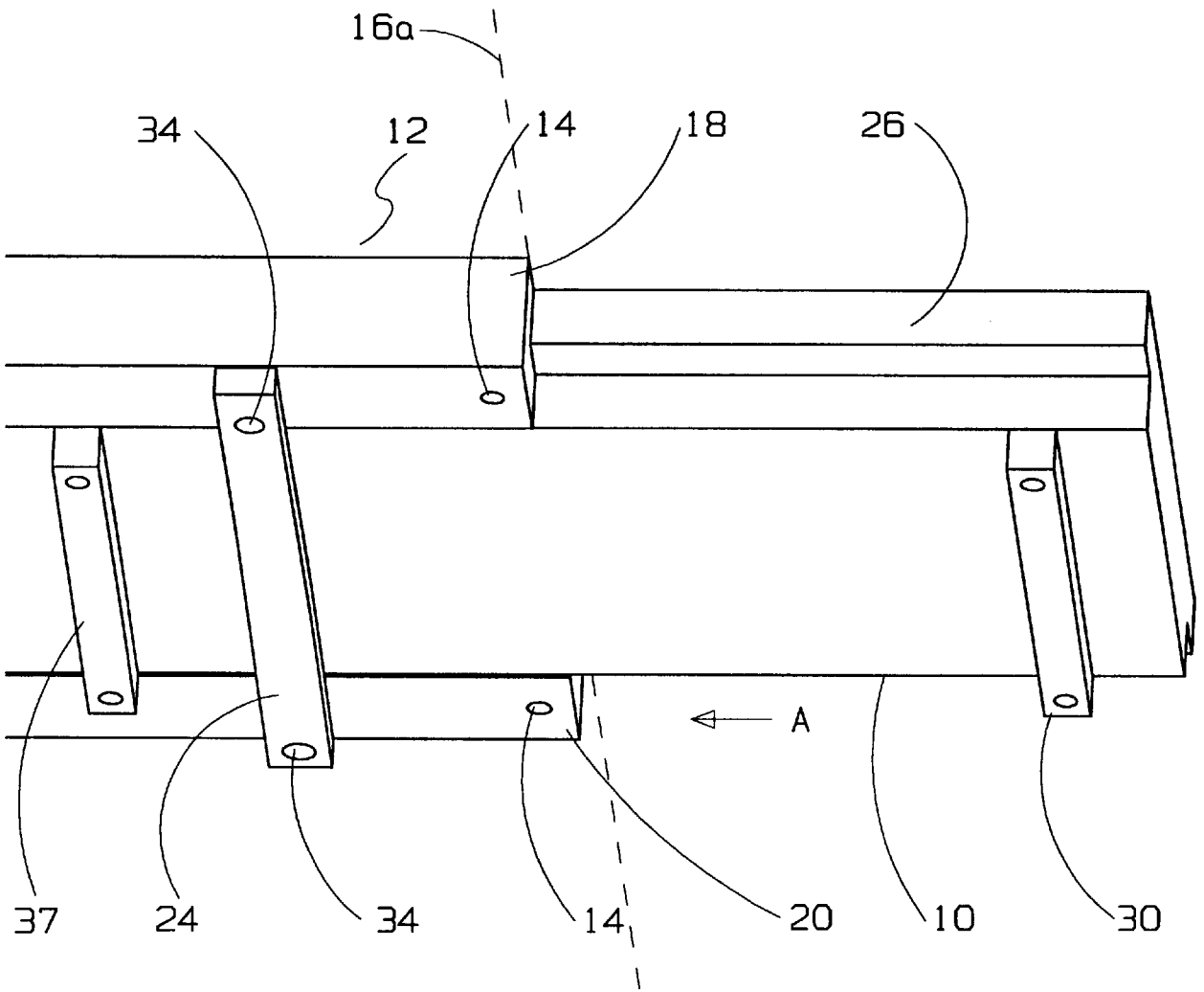
FIG. 2 is, a bottom perspective view partially cutaway, of the cantilevered sliding elbow rest of FIG. 1 the table top removed.
Figure 3:
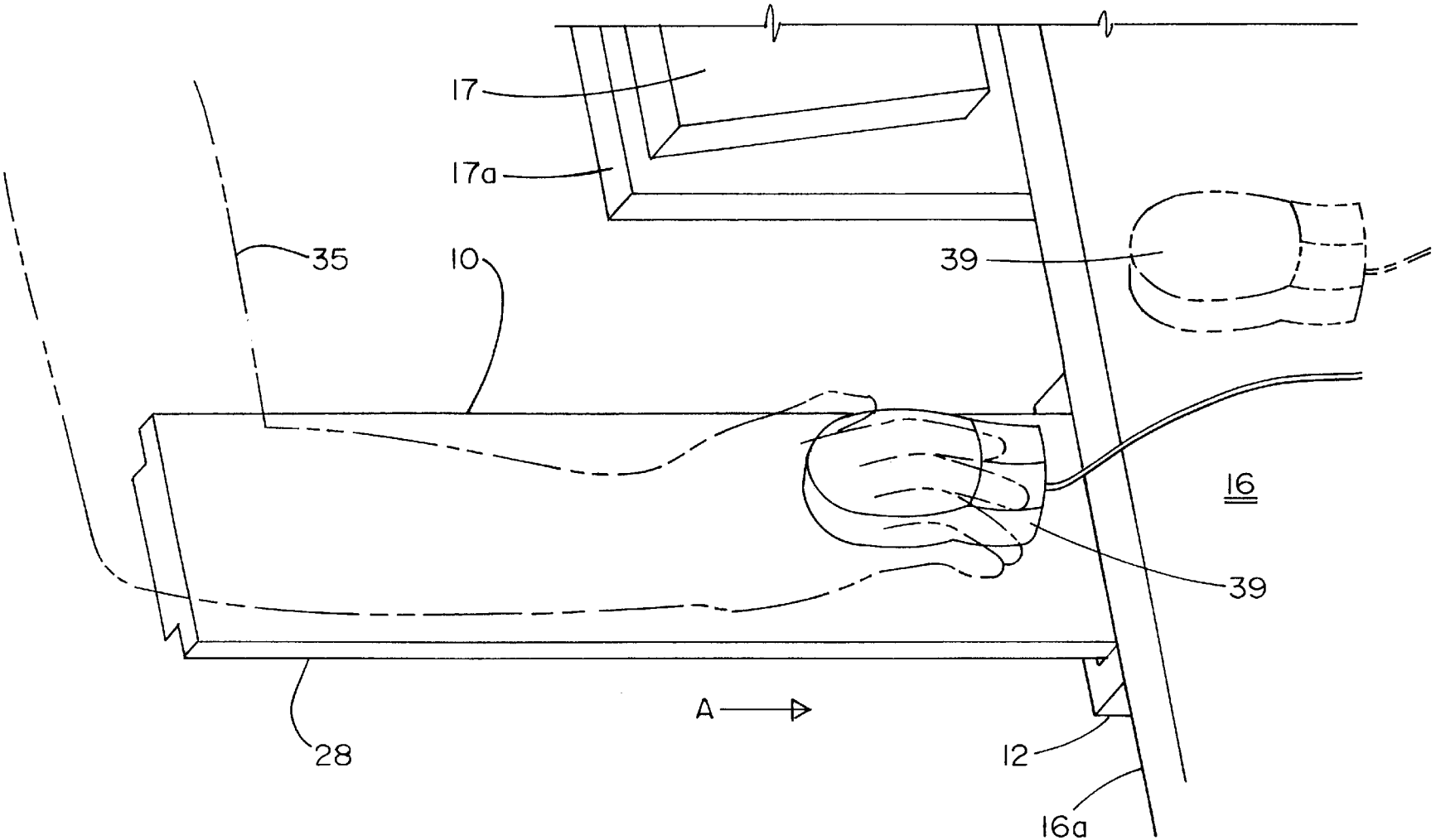
FIG. 3 is the cantilevered sliding elbow rest of FIG. 1 in use in its fully extended position.

Although shown in FIG. 1 as protruding outwardly of the outer edge 16*a* of table top 16, i.e. the edge closest to an operator, it is understood that mounting bracket 12 may be recessed underneath table top 16 or, as seen in FIGS. 2 and 3, mounted flush with edge 16*a* of table top 16 so that when cantilevered member 10 is slid into its retracted position beneath tabletop 16 by sliding in direction A, edge 16*a* of table top 16 is free from protruding obstructions.

Figure 4:
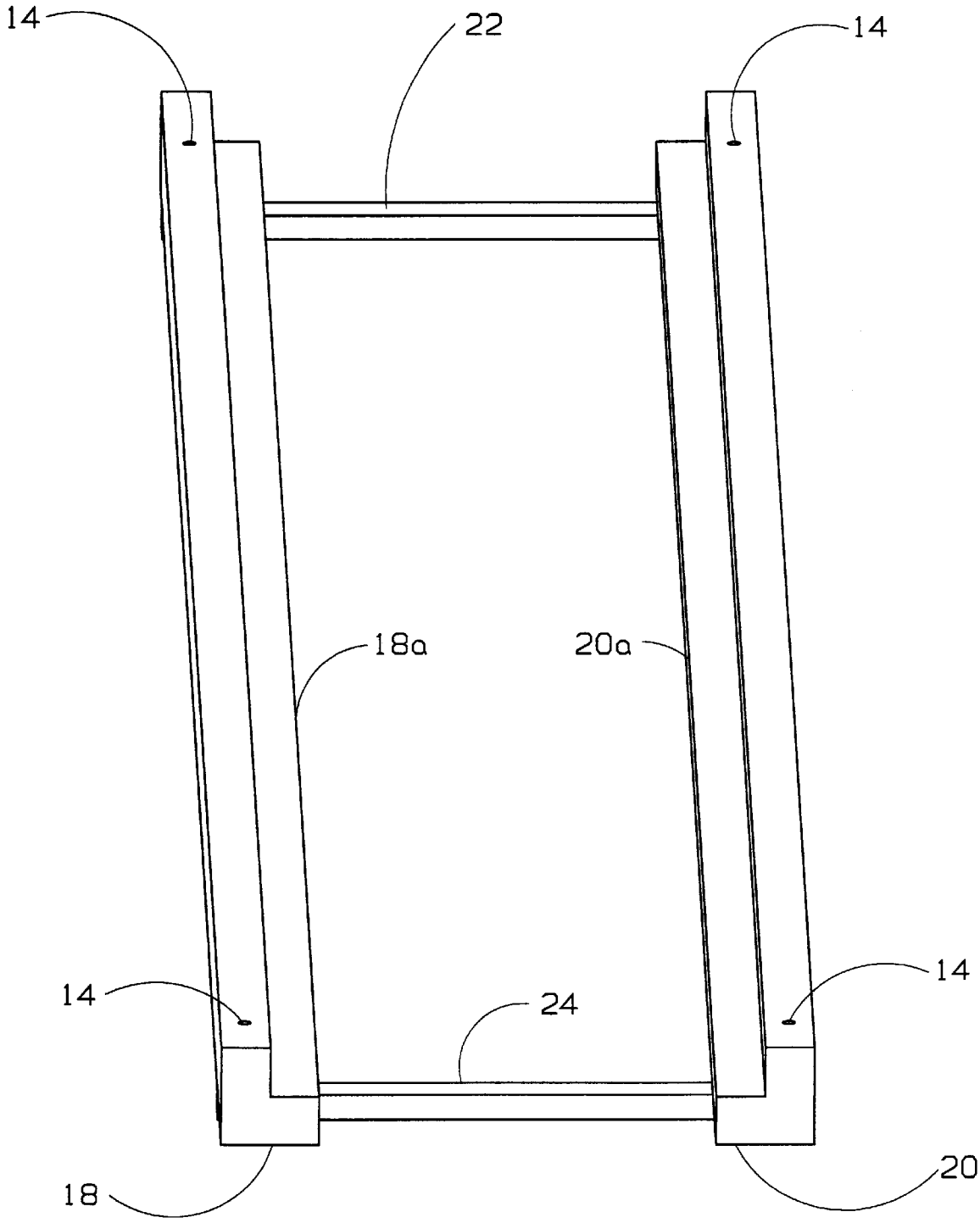
FIG. 4 is, in front perspective view, the mounting bracket on which may be slidably mounted the cantilevered sliding elbow rest of the present invention.
Figure 5:
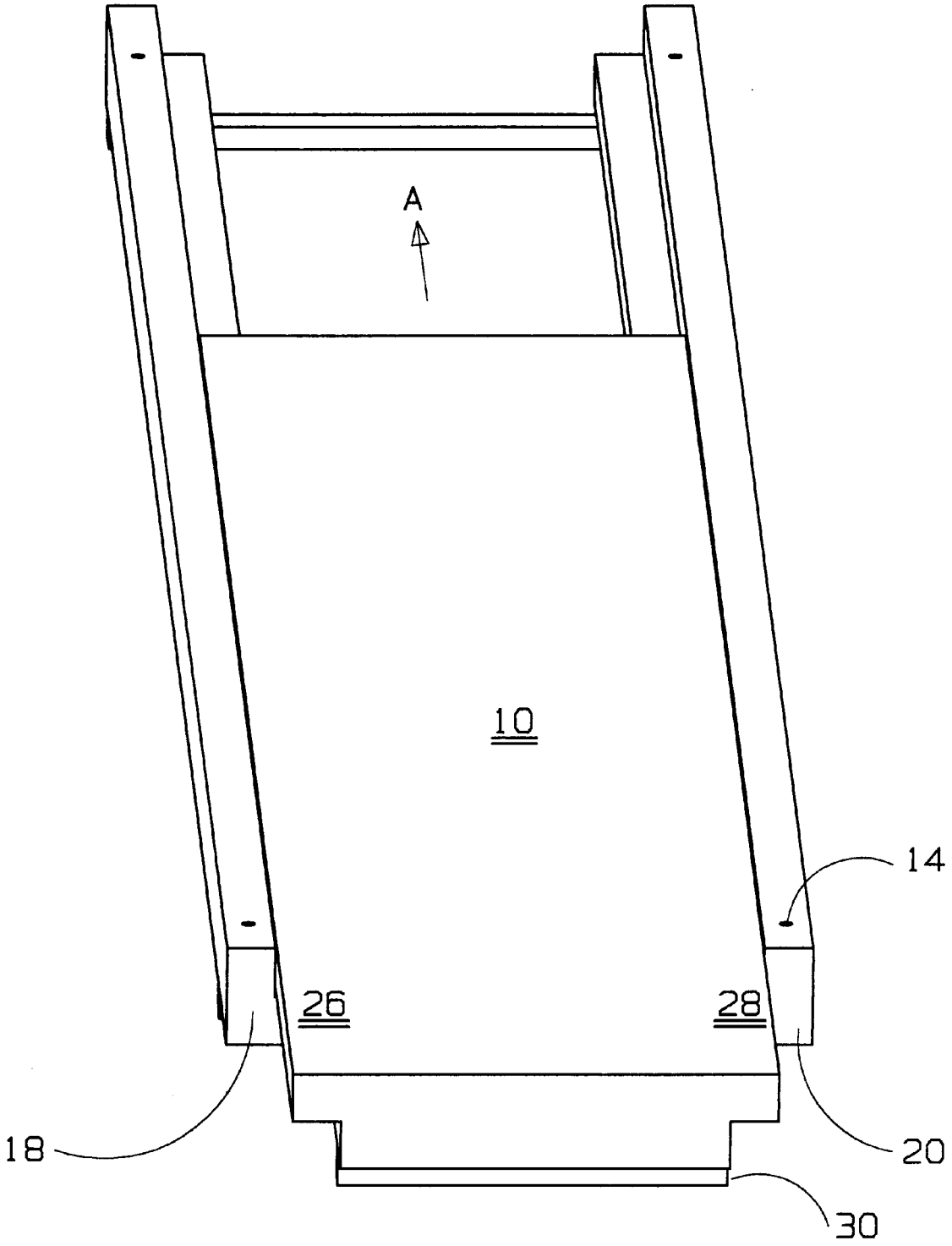
FIG. 5 is, in front perspective view, the cantilevered sliding elbow rest and mounting bracket of FIG. 4.

Mounting bracket 12 is shown in FIGS. 4 and 5 removed from its mounted position underneath table top 16. As may be seen, cantilevered member 10 slides in the channel formed between opposed facing longitudinally extending parallel rails 18 and 20. Rails 18 and 20 are held rigidly spaced apart and parallel by means of rigid cross members 22 and 24. Cross members 22 and 24 are advantageously longitudinally spaced apart along the length of rails 18 and 20.

Rails 18 and 20 are formed so that opposed facing lower flanges 18*a* and 20*a* respectively have upper surfaces which mate with the lower surfaces of flanges 26 and 28 on cantilevered member 10. The lower surfaces of flanges 26 and 28 slide over the upper surfaces of flanges 18*a* and 20*a* respectively as cantilevered member is pulled outwardly of mounting bracket 12 into its extended cantilevered position, or is retracted in direction A into its stowed position snugly resting between rails 18 and 20.

In its stowed position, advantageously, a stop 30 is mounted, for example by means of screws, to the underside of cantilevered member 10 so that when cantilevered member 10 is in its fully retracted position between rails 18 and 20, stop 30 abuts cross member 24. Cross member 24 and cross member 22 may be rigidly mounted to the underside of rails 18 and 20 by means of, for example, screws 34. Stop 30, if mounted at the outer end of member 10, may provide a pull for a user 35 to grasp, instead of functioning as a stop. In that case, a second stop may be provided to contact cross member 22.

As will be understood by those skilled in the art, although the present embodiment is depicted as being constructed of wood and fastened by means of screws, other materials such as plastic or metal may be employed and rails 18 and 20 may be formed as a single unitary piece including cross members 22 and 24.

Thus in use, the cantilevered member 10 of the present invention may be slid outwardly in an opposite direction to direction A so as to extend cantilevered member 10 for resting thereon of the elbow and/or forearm of user 35. A mouse 39 may then be placed on the exposed upper surface of member 10 and thus the forearm of user 35 may be laid generally flush on top of member 10 or at least at a much more relaxed angle relative to the horizontal than if mouse 39 was, as shown in dotted outline, placed conventionally on table top 16. This reduces the distance the hand of user 35 travels and reduces the amount of canting or bending of the wrist, thereby reducing fatigue and stress on the wrist, and forearm.

One end of cantilevered member 10 is left in snug sliding engagement between rails 18 and 20. A second stop 37 may be mounted at the inner end of cantilevered member 10, that is, on the opposite end from stop 30. As cantilevered member 10 is slid outwardly, second stop 37 is slid into abutment with cross member 24 thereby arresting any further outward sliding movement of cantilevered member 10. This leaves sufficient length of cantilevered member 10 sandwiched between flanges 18*a* and 20*a* and the underside of table top 16 so as to resist the pivoting moment applied to the outermost end of cantilevered 10 when supporting the weight of the forearm of user 35. It is understood that in the preferred embodiment, the upper surface of cantilevered member 10 is generally flush with the upper surface of rails 18 and 20 so that as cantilevered member 10 is slid in mounting bracket 12, it slides snugly underneath the lower surface of table top 16.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A cantilevered sliding elbow rest comprising:

a cantilevered member, a mounting bracket for slidably supporting said cantilevered member and adapted for rigid mounting to an underside surface of a table top, said mounting bracket having an opposed facing pair of laterally spaced apart longitudinally extending rails rigidly mounted in parallel spaced apart relation so as to accept in sliding engagement therebetween said cantilevered member, wherein said opposed facing rails each have a lower longitudinally extending sliding support surface on which said cantilevered member may be slidably supported when mounted in sliding engagement on said pair of rails, said cantilevered member generally planar and rigid so that when said mounting bracket is mounted to said underside surface of said table top, and said cantilevered member is slidably mounted in said mounting bracket, said cantilevered member may be slid from a stowed position stored snugly between said opposed pair of rails and snugly sandwiched between said supporting surfaces and said underside surface of said tabletop, to an extended position wherein a first portion of said cantilevered member is cantilevered outwardly of said mounting bracket and a downward bending moment applied to said first portion of said cantilevered member is resisted by a second portion of said cantilevered member remaining in snug sliding engagement in said mounting bracket beneath said table top, wherein said pair of rails are held in parallel spaced apart relation by at least one rigid cross member mounted between said pair of rails, and wherein laterally outer edges of said cantilevered member have lower longitudinally extending grooves so as to form outwardly extending longitudinal flanges therealong for sliding mating engagement on said supporting surfaces on said pair of rails.

2. The elbow rest of claim 1 wherein an upper surface of said cantilevered member is flush with upper surfaces of said pair of rails when said cantilevered member is mounted between said pair of rails so as to be snugly slidable beneath said underside surface of said table top.

3. The elbow rest of claim 2 wherein a stop is mounted to a lower surface of said cantilevered member so as to limit a range of sliding motion of said cantilevered member relative to said mounting bracket, wherein when said stop is mounted at an outer end of said cantilevered member, and wherein said at least one cross member is an outer cross member and said stop abuts said outer cross member when said cantilevered member is in said stowed position.

4. The elbow rest of claim 3 further comprising a second stop mounted at a second end of said cantilevered member opposite said outer end of said cantilevered member so as to abut said outer cross member when said cantilevered member is fully extended.

* * * * *